US005709416A

United States Patent [19]

Wood

[11] Patent Number: 5,709,416

[45] Date of Patent: Jan. 20, 1998

[54] THREADED COUPLING-TOOL JOINT

[76] Inventor: Roy Wood, 119 Persimmon St., Birmingham, Ala. 35214

[21] Appl. No.: 632,621

[22] Filed: Apr. 15, 1996

Related U.S. Application Data

[63] Continuation-in-part of Ser. No. 286,178, Aug. 5, 1994, abandoned.

[51] Int. Cl.[6] ..... F16L 25/00

[52] U.S. Cl. ..... 285/330; 285/333

[58] Field of Search ..... 285/334, 333, 285/328, 355, 390, 330; 403/364, 343

[56] References Cited

U.S. PATENT DOCUMENTS

| | | | |
|---|---|---|---|
| 1,474,905 | 11/1923 | Keszthelyi | 285/333 X |
| 3,667,784 | 6/1972 | Hokanson et al. | 285/334 X |
| 4,494,777 | 1/1985 | Duret | 285/334 X |
| 4,525,001 | 6/1985 | Lumsten et al. | 285/328 |
| 4,538,840 | 9/1985 | Delange | 285/333 |
| 4,611,838 | 9/1986 | Heilmann et al. | 285/334 X |
| 4,813,717 | 3/1989 | Watts | 285/333 |
| 5,169,183 | 12/1992 | Hallez | 285/334 |

FOREIGN PATENT DOCUMENTS

| | | | |
|---|---|---|---|
| 357271 | 9/1931 | United Kingdom | 285/334 |

*Primary Examiner*—Dave W. Arola
*Attorney, Agent, or Firm*—John K. Donaghy

[57] ABSTRACT

There is provided a tool joint having a box and a pin wherein the box has threads therein; and wherein the box and the pin each are provided with complementary surfaces which engage one another upon threading of the box and the pin together.

5 Claims, 3 Drawing Sheets

THREADED COUPLING-TOOL JOINT

RELATED APPLICATION DATA

This is a continuation-in-part of application Ser. No. 08/286,178, filed Aug. 5, 1994, now abandoned.

BACKGROUND OF THE INVENTION

1. Field of the Invention

This invention pertains to threaded couplings (bolts, nuts, pipes, rods, tubes, etc.), but more particularly for this application, drill string tool joints.

2. Background of the Prior Art

The prior art discloses numerous systems of threadedly coupled drill pipe creating a hollow drill string threadedly attached to the drill system on the drive end and the drill bit on the driven end. The hollow drill string permits passage of either drilling mud or gaseous drilling fluid such as air to function as a cooling means to the drill bit and as a medium for conveying the cuttings to the surface. Such drill strings are threadedly coupled to attain the depth desired.

The state of the art threaded couplings-tool joints are well known by those in the industry as API-B.E., etc., tapered threaded tool joints.

For example, L. W. Hokanson et al, U.S. Pat. No. 3,667,784, shows a drill rod structure which includes pipe sections 10 and 11, and a coupling 12 therebetween. Torque shoulders are provided between the pipe and coupling parts, and a thread locking compound is applied prior to assembly. Square threads are employed between the coupling halves, and an O-ring seal is also provided.

W. S. Gattrell, in Great Britain Patent No. 357,271, discloses pipe and coupler sections which are joined by a spigot and socket arrangement, but a separate sealing ring 20 is still required.

Another example of prior art drill pipe joints is shown by J. Duret in U.S. Pat. No. 4,494,777. This patent includes a square cut threaded joint structure with the threads at closed angles thus creating an interlocking action.

The prior art discloses no means to offset the force vectors which cause movement in the threaded coupling-tool joints under working conditions, but utilizes heavy lubricating compounds to reduce wear and galling.

SUMMARY OF THE INVENTION

There is a need for a tool joint (threaded coupling) in the drilling industry that offers a longer useful life, stronger connection, and eliminates action in the tool joint under load from vector forces which cause failure due to fatigue, galling, and wear from mis-matching of threads when coupling.

This invention also comprehends the need in some applications to machine relief flutes in the load bearing surfaces to compensate for foreign matter present in the tool joint when not properly cleaned and prepared for proper threading.

This invention also comprehends the application of this technology as used in all threaded applications, bolts, nuts, pipes, tubes, rods and any other threaded application now being used or contemplated.

The purpose of this invention is to provide a threaded coupling-tool joint that utilizes the forces and force vectors present in threaded couplings and more specifically tool joints to reduce or eliminate action of the tool joint and use these forces and vectors to strengthen it when under load.

A further purpose of this invention is to make a stronger threaded coupling in bolts, nuts, pipes, tubes, rods, and any other threaded application being used or contemplated by use of the undercut thread design to reverse the force vectors which cause the thread load bearing surfaces to tend toward each other rather than trying to force themselves apart, thus weakening the threads.

It is therefore an object of this invention to provide a threaded coupling-tool joint that comprehends these problems and is designed to reduce or eliminate them.

It is yet another object of this invention to provide a thread for bolts, nuts, pipes, tubes, rods, and any other device used or contemplated.

It is yet another object of this invention to utilize the force vectors present under working conditions to strengthen the tool joint by eliminating or reversing the axial force vectors.

It is yet another object of this invention to provide a mortise and tenon on the threaded pin section of the joint and a corresponding mortise and tenon on the threaded box section of the joint with matched tapered load bearing surfaces to offset any axial action under working conditions. The unique shape of these moritse and tenon elements also eliminates the need for an additional sealing means between pipe sections.

It is yet another object of this invention to provide a threaded coupling-tool joint having multiple load bearing surfaces all designed according to the best engineering practices to reduce the PSI and action under working conditions and reduce or eliminate wear and ultimate failure due to excess action in the tool joint.

It is yet another object of this invention to utilize the best engineering practices to provide a tool joint that reaches its maximum strength under maximum load with all load bearing surfaces properly seated, minimizing the load PSI.

It is yet another object of this invention to provide the threaded coupling-tool joint having a longer life expectancy as a result of reduced stresses by force vectors. The forces present within the joint members are directionalized along the plane of the drill pipe axis to not only strengthen the joint, but also provide self-adjustment for wear.

It is yet another object of this invention to provide a threaded coupling-tool joint having a longer life expectancy as a result of increased load bearing surfaces thus reducing load PSI and resulting failures.

It is yet another object of this invention to provide a threaded coupling-tool joint with self aligning characteristics when coupling thus reducing thread damage and shorter life expectancy.

It is yet another object of this invention to provide a threaded coupling-tool joint having the life expectancy of the pipe it is threadedly coupling, thus reducing operational costs.

DETAILED DESCRIPTION OF THE PREFERRED EMBODIMENT OF THE INVENTION

Now to more specific details of the drawings of this invention.

Figure 1:
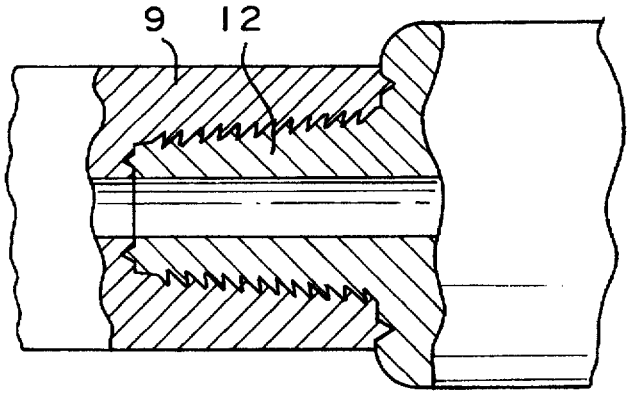
FIG. 1 depicts a cross-sectional view of a tool joint with pin and box threadedly engaged together.
Figure 2:
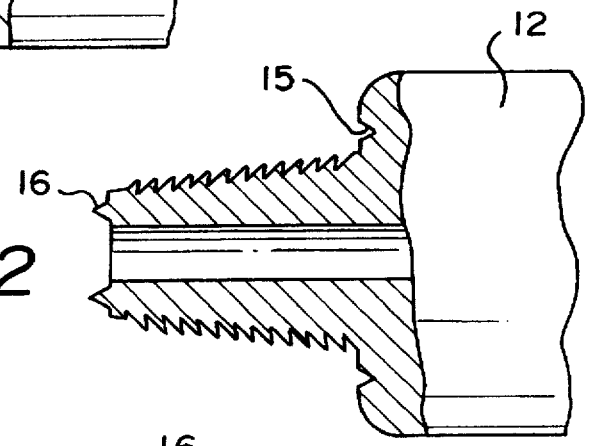
FIG. 2 depicts the threaded pin section showing a mortise on the pin shoulder and a tenon on the end of the pin.
Figure 3:
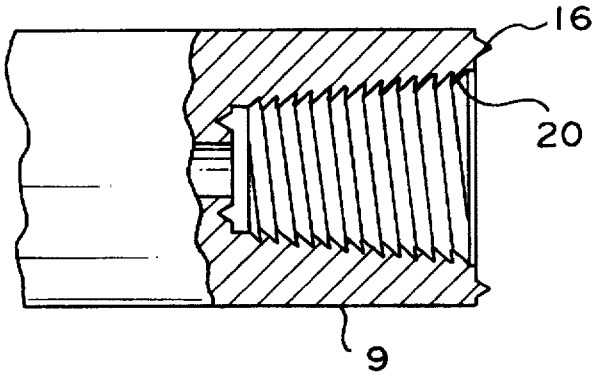
FIG. 3 depicts the threaded box section showing a mortise on the inside shoulder and a tenon on the outside shoulder.
Figure 12:
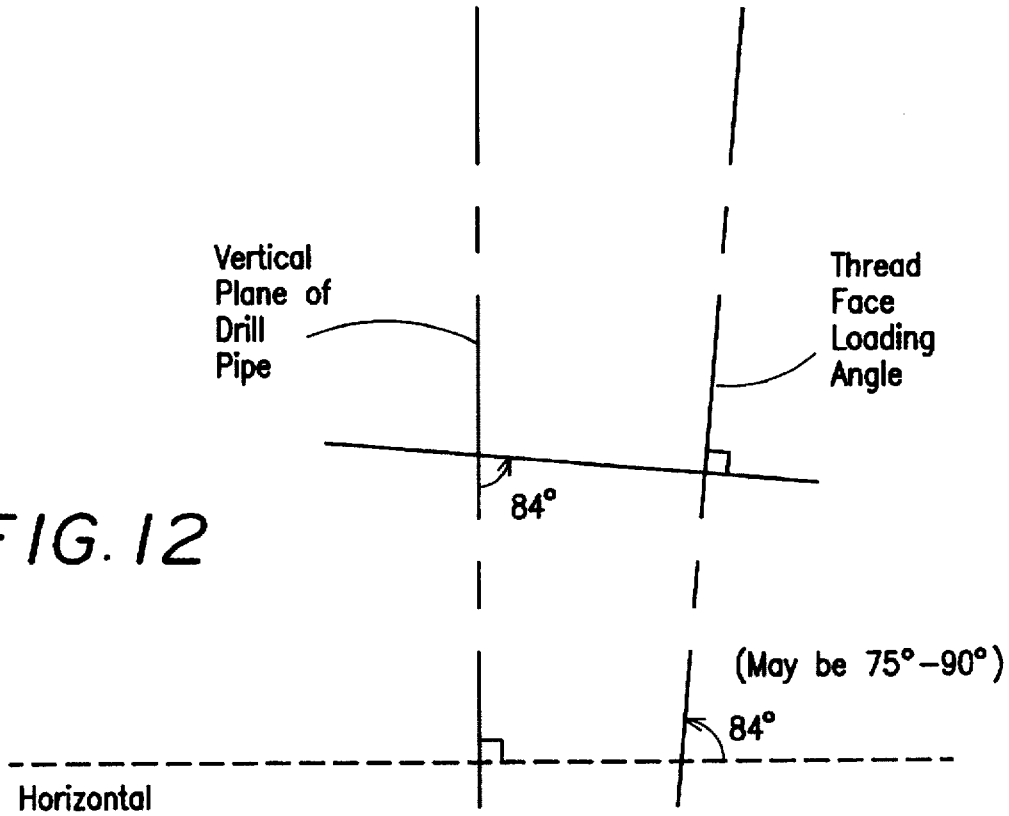
FIG. 12 shows the preferred undercut angle for the threaded portion of the box and pin sections of the invention.

FIGS. 1–3 of the drawings depict this new technology employing a slight undercut A on the load bearing face of the threads in both the box and pin sections. The amount of this undercut is to be determined by the application and best engineering practices, but for the purposes of this particular application, the preferred amount of undercut is eighty-four degrees as illustrated in FIG. 12. Experience and testing may determine that a different angle performs better, and changing of the angle is allowable without departing from the scope of the invention. The purpose is to redirect the force vectors present under working conditions such that they are aligned with the axis of the drill pipe string. The result is the reduction or elimination of action in the tool joint, or threaded coupling, under working conditions.

Figure 11:
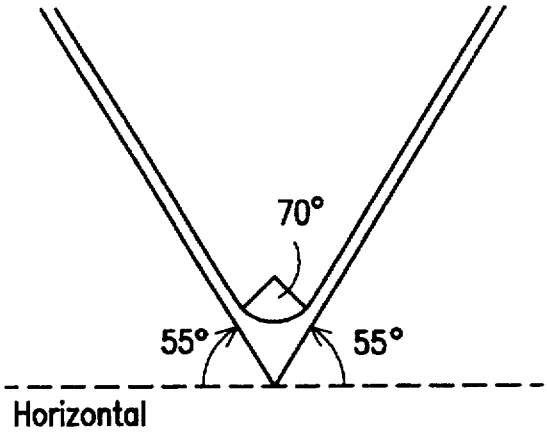
FIG. 11 shows the preferred angles and fit of the mortise and tenon of the invention.

These drawings depict this new technology employing a mortise 14 and tenon 16 in the box section 9 and the pin section 12. The size and angles of the mortises and tenons will be determined by the application and best engineering practices, but for this example, the preferred dimensions are as shown in FIG. 11, with the mortise and tenon surfaces angled at 55 degrees from the horizontal. As can be seen from the drawing, the peak of the tenon is radiused in a seventy degree arc to allow a clearance between the mortise and tenon for the collection of foreign matter and lubricant. Of course, these specific angles may be altered within the scope of the invention if experience proves that a different angle performs better than those set forth here. The purpose is to utilize all forces acting on the pin and box threaded sections under working conditions to secure the joint parts against any movement which might tend to separate them. The result is the reduction or elimination of vector forces that cause or allow action in the threaded coupling or tool joint under working conditions.

It should also be understood that the location of the mortise and tenon on the pin and box members may be reversed without departing from the scope of the invention.

Figure 4:
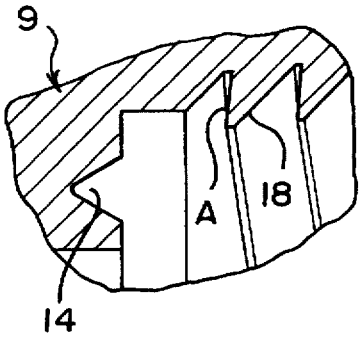
FIG. 4 shows a sectional view of the box showing close up details of the mortise on the inside shoulder.
Figure 5:
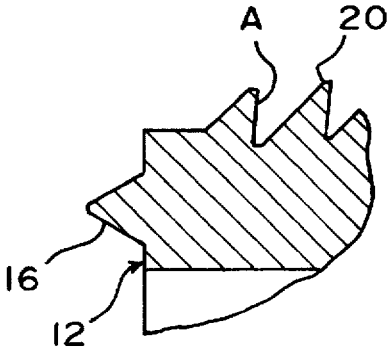
FIG. 5 is a sectional view of the pin showing close up details of the tenon and the undercut on the threads.

FIGS. 4 and 5 show box 9 and pin 12 with load bearing surfaces 1, 2, 3, and 4, 5, 6 respectively with 1 and 2 of the box 9 being the load bearing surfaces of the box section and mortise 14; surfaces 4 and 5 are load bearing surfaces of the pin tenon 16. Both mortise 14 and tenon 16 are matched tapered surfaces which couple together and function to prevent axial motion of the coupling. This coupling occurs during the last infinitesimal turn of the pin on the box. The surface threads 18 in the box 9 are undercut and function as load bearing surfaces of the box section threads. Surfaces 6 of the pin threads 18 are undercut load bearing surfaces which are matched with the pin threads 18 at such an undercut angle as to function to eliminate or reverse the axial forces present in the state of the art threaded couplings.

Figure 6:
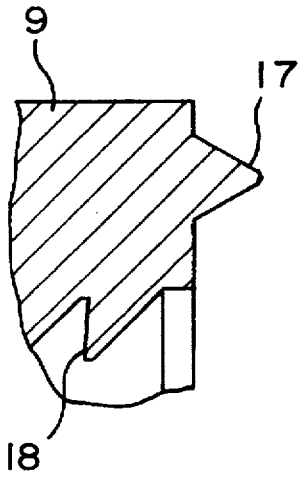
FIG. 6 is a sectional view of the box showing close up details of the tenon on the outside shoulder.
Figure 7:
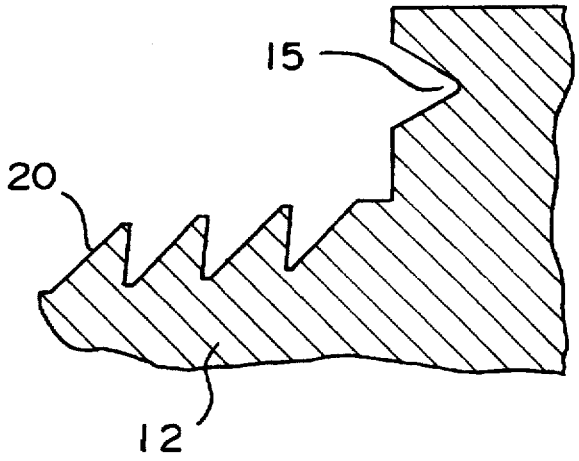
FIG. 7 is a sectional view of the pin showing close up details of the mortise on the outside shoulder.
Figure 9:
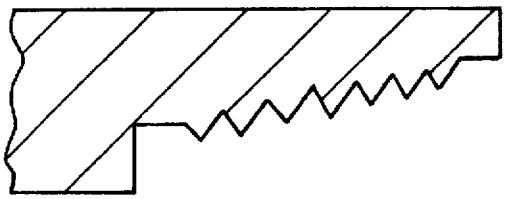
FIG. 9 PRIOR ART
FIG. 9 shows details of the box section.
Figure 10:
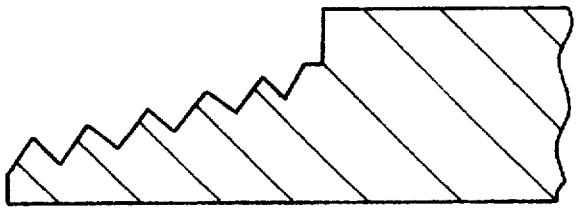
FIG. 10 PRIOR ART
FIG. 10 shows details of the pin section.
Figure 8:
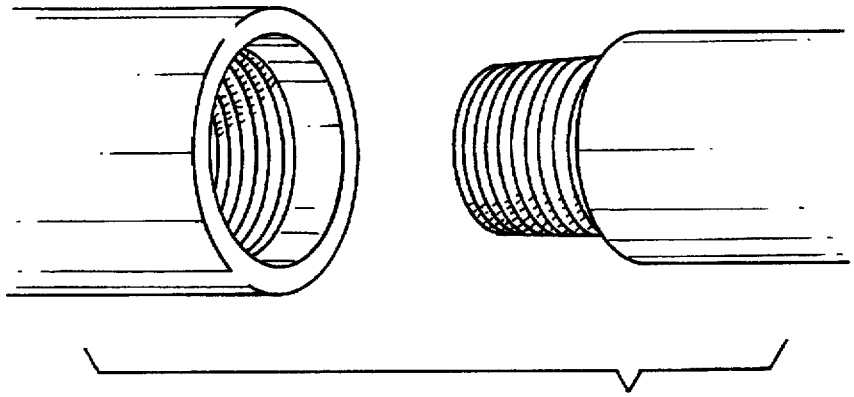
FIG. 8 PRIOR ART
FIG. 8 shows the current state of the art.

FIGS. 6 and 7 show load bearing surfaces 7, 8, and 9 of the box 9 and surfaces 10, 11, and 12 of the pin 12. Surfaces 8 and 9 are the load bearing surfaces of the box tenon 17 and surfaces 11 and 12 are the load bearing surfaces of the pin mortise 15. Both mortise 15 and tenon 17 mate together and function to prevent axial motion between the box 9 and the pin 12. The surface of the box threads 18 are undercut and function as bearing surface of the box section thread. The surface 10 of the pin 12 is undercut and functions as load bearing surface of the pin thread sections 20. Surfaces 7 and 10 of the box 9 and pin 12 are threads 18 and 20 which function as load bearing surfaces and are matched cut at such an undercut angle as to eliminate or reverse axial forces present in the state of the art threaded couplings.

All forces working on the box/pin threads and tenon/mortise function to keep the joint together. The slight undercut of the matching threads 18 and 20 work with the axial vector forces to keep the joint together. The vector forces are offset by the mortise and tenon sections. Indeed, it appears that the vector forces are neutralized or reversed.

The undercut of the thread sections together with the tenon and mortise sections provide a tool joint which will not flex thereby prolonging the life of the tool.

While specific embodiments of the invention have been described in detail, it will be appreciated by those skilled in the art that various modifications and alternatives to those details could be developed in light of the overall teachings of the disclosure. Accordingly, the particlar arrangements disclosed herein are meant to be illustrative only and not limiting as to the scope of the invention which is to be given the full breadth of the appended claims and any and all equivalents thereof.

What I claim is:

1. A tool joint coupling including a box section and a complementary pin section comprising:

said box section having threads on an internal surface thereof and having an internal and an external shoulder;

a mortise member centrally disposed on one of said shoulders and a tenon member centrally disposed on the other thereof;

said pin section having threads on an external surface thereof and having an internal shoulder and an external shoulder, a mortise member centrally disposed on one of said shoulders and a tenon member centrally disposed on the other of said shoulders such that when said box and said pin sections are threaded together said centrally disposed tenon members will engage said centrally disposed mortise members to provide a tool joint upon which vector forces resulting from drilling operations conducted with said tool joint are aligned with and parallel to the central axis of said tool joint and will assist in keeping said tool joint together; and said inner and outer mortise and tenon member on said box and pin sections providing identically matched tapered load bearing surfaces when seated together.

2. A tool joint according to claim 1, wherein:

said box section threads and said pin section threads are disposed on a tapered surface and complementarily engage each other upon threading one to the other.

3. A tool joint according to claim 1, wherein:

said mortise and said tenon of said pin are centrally located on an outside shoulder and on an inside shoulder respectively; and said mortise and said tenon of said box are centrally located on an inside shoulder and on an outside shoulder respectively.

4. A tool joint according to claim 3, wherein:

said pin shoulders with centrally located mortise and tenon seat against said box shoulders with centrally located mortise and tenon upon threading of said pin into said box such that said pin and said box are held firmly together.

5. A tool joint comprising:

a box and a pin having internal and external load bearing shoulders;

said box and said pin having threads therein;

mortise and tenon members on said shoulders;

said shoulders and said mortise and tenon members of said box and said pin each being provided with identically matched load bearing surfaces which engage one another upon threading of said box and said pin together; and the engagement of said identical load bearing surfaces forming a tight joint between said box and said pin such that vector forces acting the tool joint are eliminated.

* * * * *